US006840351B2

(12) United States Patent
Wanner

(10) Patent No.: US 6,840,351 B2
(45) Date of Patent: Jan. 11, 2005

(54) CONTROL DEVICE FOR A LIFTING PLATFORM

(75) Inventor: Hubert Wanner, Haldenwang (DE)

(73) Assignee: Maha Maschinenbau Haldenwang GmbH & Co. KG, Haldenwang (DE)

( * ) Notice: Subject to any disclaimer, the term of this patent is extended or adjusted under 35 U.S.C. 154(b) by 0 days.

(21) Appl. No.: 09/851,015

(22) Filed: May 8, 2001

(65) Prior Publication Data

US 2002/0005319 A1 Jan. 17, 2002

(30) Foreign Application Priority Data

May 9, 2000 (DE) ..... 200 08 313 U

(51) Int. Cl.[7] ..... B66F 7/00
(52) U.S. Cl. ..... 187/205; 187/203
(58) Field of Search ..... 187/203, 205, 187/276, 277, 391, 414, 413, 222

(56) References Cited

U.S. PATENT DOCUMENTS 3,936,333 A * 2/1976 Behunin ..... 52/747 X
5,993,146 A * 11/1999 Hallgren ..... 187/269 X
6,325,176 B1 * 12/2001 Jensen ..... 187/222

FOREIGN PATENT DOCUMENTS

| | | | |
|---|---|---|---|
| DE | 32 35 829 | | 9/1982 |
| DE | 3152422 | A1 * | 3/1983 |
| DE | 39 16 048 | | 5/1989 |
| DE | 44 30 568 | | 8/1994 |
| DE | 197 24 235 | | 6/1997 |
| EP | 960770 | A1 * | 12/1999 |
| EP | 1129897 | A1 * | 9/2001 |

* cited by examiner

*Primary Examiner*—Eileen D. Lillis
*Assistant Examiner*—Thuy V. Tran
(74) *Attorney, Agent, or Firm*—Kenyon & Kenyon

(57) ABSTRACT

An operating device for a lifting platform, particularly for a vehicle lifting platform, includes a housing including a plurality of operating elements for operating the lifting platform. The housing is arranged in the floor in a sunken manner and includes a cover disposed on the floor level, in which the operating elements formed as foot switches are disposed.

7 Claims, 4 Drawing Sheets

CONTROL DEVICE FOR A LIFTING PLATFORM

FIELD OF THE INVENTION

The present invention relates to an operating device for a lifting platform, particularly for a vehicle lifting platform comprising a housing including several control elements for operating the lifting platform.

BACKGROUND INFORMATION

Conventional operating devices for lifting platforms normally have a switching box attached to a wall or a column in which control members are accommodated and on the wall of which operating elements and displays such as switches for lifting and lowering the lifting platform are disposed (see, for example, German Published Patent Application No. 32 35 829). Particularly in large rooms or halls, switching boxes mounted on a wall are often positioned at a large distance to the lifting platform, so that their operation is rendered difficult. Especially in recent times, halls for vehicle repair services or also demonstration halls are formed as glass and steel constructions having neither brick walls nor wide columns for mounting the switching boxes. Alternative options, such as, for example, operating members suspended on the ceiling or operating boxes standing in the room will interfere with the maneuvering of the vehicles within the room and will disturb the optical impression.

In German Published Patent Application Nos. 39 16 048 and 44 30 568, so-called shovel loader platforms for utility vehicles are described which serve as loading aids to lift or to lower the items to be loaded from the floor to the level of the platform when the rear flap is lowered.

These shovel loader platforms are generally arranged on the rear end of the vehicle and include a platform that can carry out lifting and lowering motions with the aid of pressure cylinders as well as a swivelling motion in its lifted state. On the platform, operating elements for the pressure cylinders are arranged adjacent to each other and formed as foot switches, which may be operated in a predetermined sequence when the platform is in a horizontal position.

It is an object of the present invention to provide an operating device for lifting platforms which will not occupy any demonstration space inside the hall and will enable a simple operation of the lifting platform.

SUMMARY

The above and other beneficial objects of the present invention are achieved by providing an operating device as described herein. The present invention provides a complete operating device that is, from the point of view of the operability, installed in the floor in an optimum position next to the lifting platform so that no interfering operating boxes are disposed in the room and that the lifting platform may easily be operated in its immediate vicinity. Due to the arrangement of the operating device in alignment with the floor level, it may be ridden over by a vehicle without being damaged, and there are no stumbling edges for the staff either.

The installation of the operating device is taken into consideration in the construction of the floor of the hall in which the base part including the required connection pieces or empty pipes for the connection lines is placed in the desired positions and set in concrete. For the subsequent installation of the operating device a corresponding recess may be caulked into the floor into which the base part is inserted. The accommodated base part is covered on the floor level by a stable cover plate in which the operating elements formed as foot pressure switches are mounted and which consists, for example, of metal. Thus, a simple and comfortable operation with the feet is enabled.

Thus, the cover consisting, for example, of an aluminum sheet, may be arranged on the base part so that the upper side of the aluminum sheet terminates with the upper floor edge. In this way, a continuously plane floor surface is maintained, and the floor is not impeded by any larger unevenness in the area of the operating device.

In addition to the operating elements for lifting and lowering the lifting platform, a safety foot switch is disposed at a distance to these inside the cover, which safety foot switch is operated together with the corresponding operating element to activate the lifting and lowering functions. The distance between the safety switch and the operating elements is selected so that both of them may not be simultaneously operated with one foot. Instead, the respective operating element, as well as the safety switch, must be operated with one foot each for lifting and lowering the lifting platform, whereby an unintentional operation of the lifting platform is prevented. Inside the cover, an emergency off switch is provided which may be arranged at a distance to the two foot switches for lifting and lowering and adjacent thereto. Even if a larger, heavy component happens to be unintentionally positioned on the cover in the region of the operating elements the emergency off switch is activated simultaneously then and an unintended movement of the lifting platform is prevented.

In another example embodiment of the present invention, an outlet is provided in the base part of the housing via which liquids or condensate may be carried off. A sealing may be provided between the cover plate and the bottom part for preventing the entry of water, etc.

DETAILED DESCRIPTION

Figure 1:
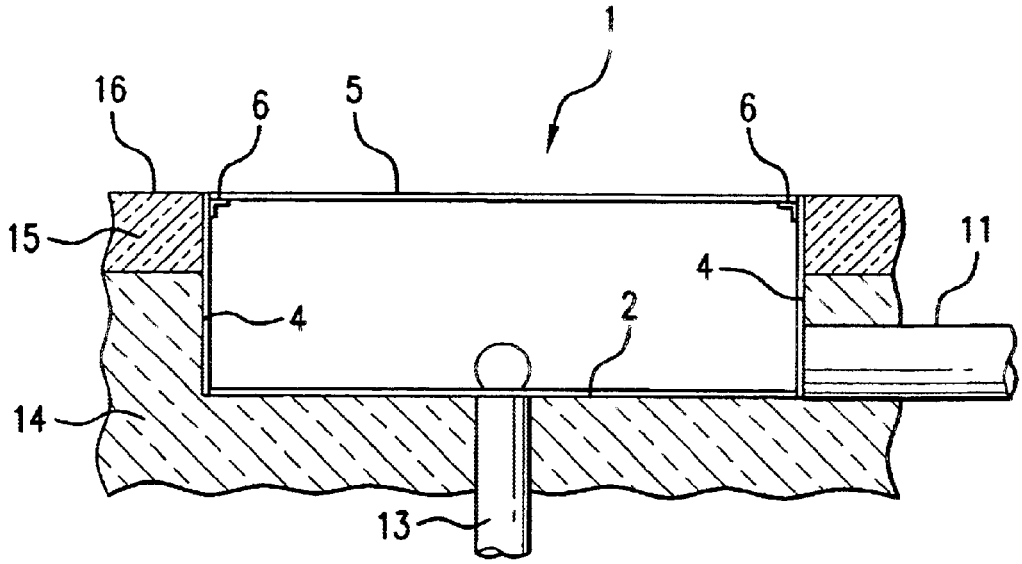
FIG. 1 is a schematic longitudinal cross-sectional view of an operating device according to the present invention.
Figure 2:
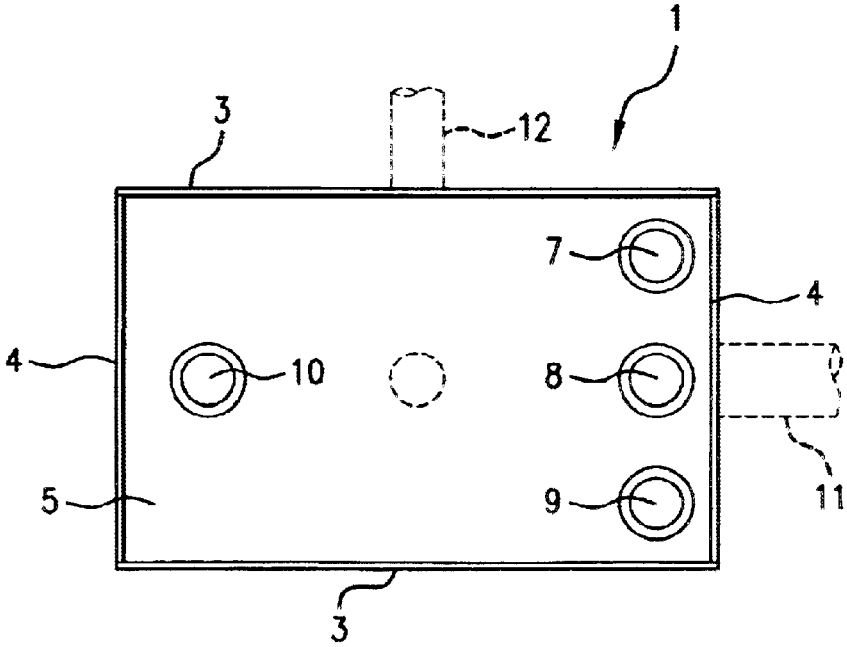
FIG. 2 is a schematic plan view of the operating device illustrated in FIG. 1.

The operating device for a lifting platform schematically illustrated in FIGS. 1 and 2 includes a housing 1 including a base part consisting of a floor plate 2 and two longitudinal and transverse walls 3 and 4 and a cover plate 5 screwed to the base part rectangular in the plan view via lateral fixing bridges 6. The cover plate 5 and the fixing bridges 6 are designed so that driving over the cover plate 5 is possible.

In the cover plate 5 consisting, for example, of an aluminum sheet, pressure switches 7, 8, 9 and 10, illustrated in FIG. 2, are mounted as operating elements. The terminals of the operating elements for the electric lines are accommodated inside the base part. On respectively one of the longitudinal and the transverse walls 3 and 4, a connection piece in the form of empty pipes 11 and 12 for the lines to a lifting platform controller and to the lifting platform and terminating in the base part are provided. In the bottom plate 2, an outlet connection piece 13 is disposed which may be connected to a corresponding outlet pipe for carrying off water, etc.

Figure 3:
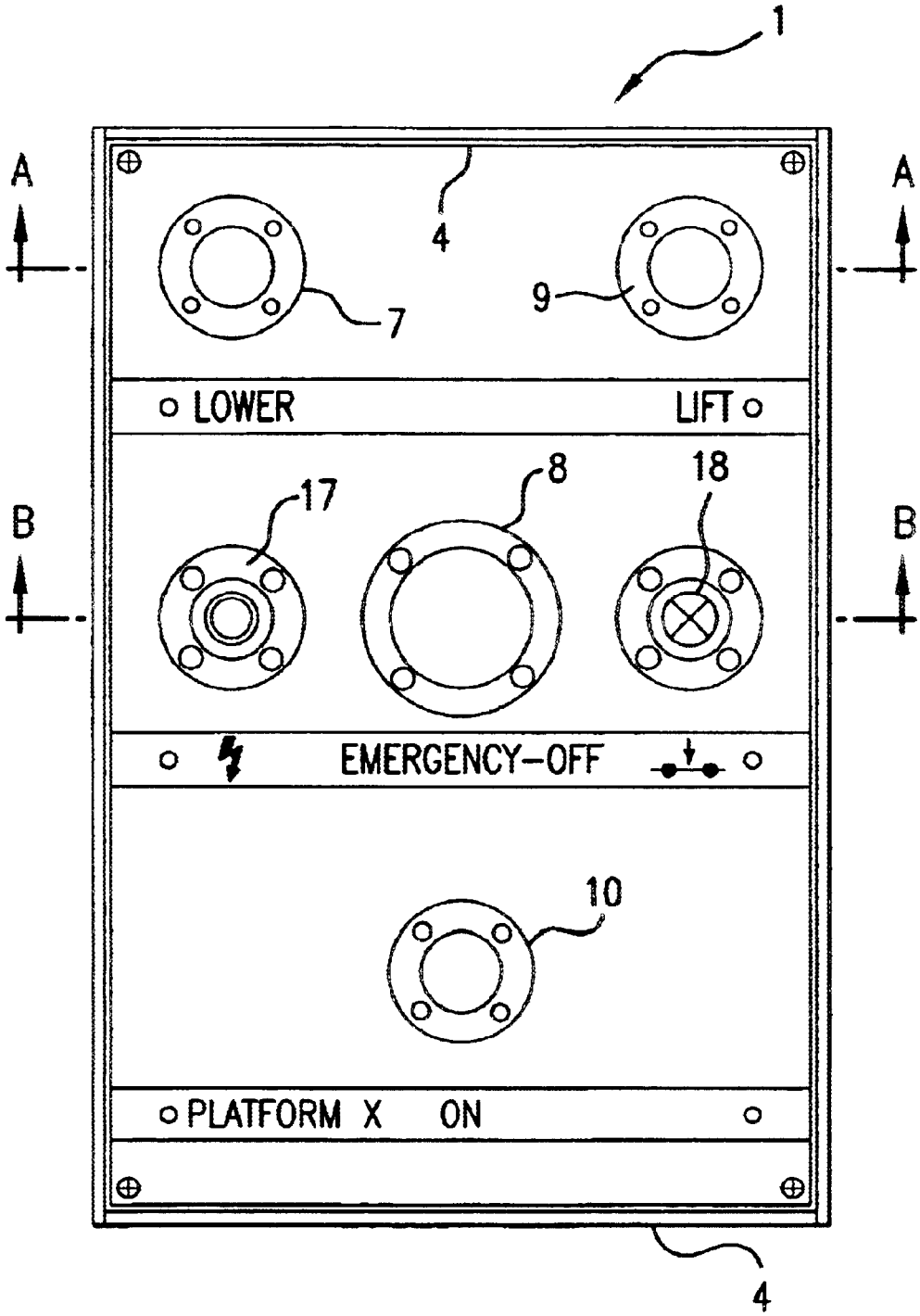
FIG. 3 is a plan view of an example embodiment of the operating device according to the present invention.
Figure 4:
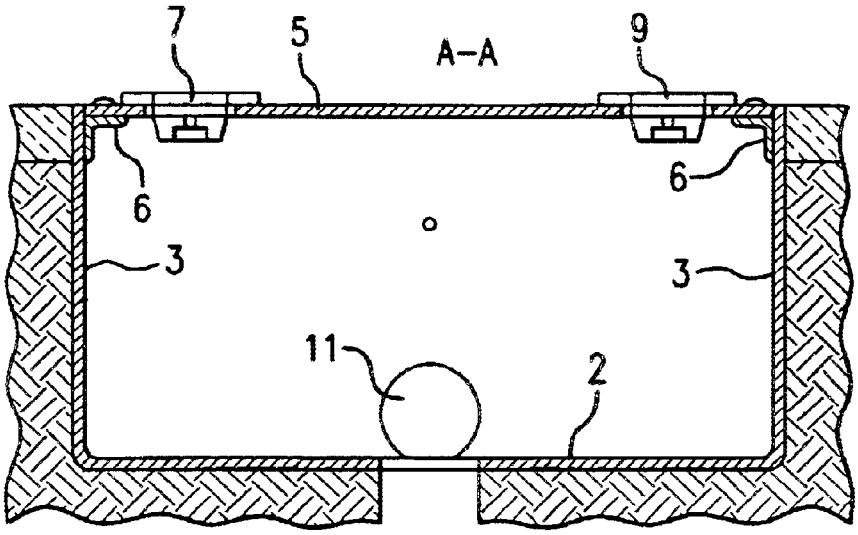
FIGS. 4 and 5 are cross-sectional views take along the lines A—A and B—B illustrated in FIG. 3.
Figure 5:
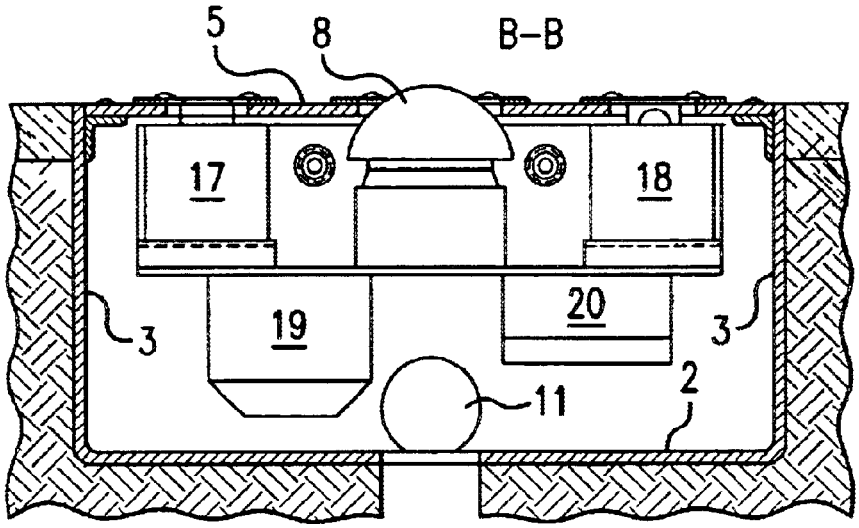

In the area of the one transverse wall 4, two pressure switches 7 and 9 for lifting and lowering the lifting platform and arranged at a distance to each other and an emergency off switch 8 arranged between them are mounted. At a distance to the switches, a safety switch 10 is arranged in the area of the other transverse wall 4, which safety switch must be operated together with the corresponding pressure switch 7 or 9 for lifting or lowering the lifting platform. The distance between the pressure switches 7 and 9 for lifting and lowering and the safety switch 10 is selected so that they cannot be operated with one foot. For lifting and lowering the lifting platform, the pressure switch 7 or 9 and the safety switch 10 must be operated simultaneously with one foot, respectively. Thus, an unintended operation of the lifting platform is prevented. The emergency off switch 10 may also be arranged in the central area, as illustrated in FIGS. 3 and 5. In addition, another foot switch 17 for activating a control voltage may be provided. The foot switch 17 is operated after an operation of the emergency off switch to re-establish the operable state. For preventing an unintended activation, the foot switch 17 may be disposed in a slightly sunken manner.

A control lamp 18 arranged laterally adjacent to the emergency off foot switch 8 is required when the lifting platform is provided with a pneumatically operated lifting platform. The axial lift must be in a defined position or alignment during a lowering operation since otherwise, inter alia, damage due to collisions with the lifting platform may occur. If the axial lift is not in the predetermined correct position during the lowering operation, the lifting platform will only be moved to an uncritical point which will be indicated by the control lamp 18. Finally, an alarm generator 19, illustrated in FIG. 5, may be provided inside the housing 1, the alarm generator generating an alarm sound during a lowering operation of the lifting platform when it passes a predetermined region. For supporting the cables (not shown) inserted into the housing 1 via the empty pipe 11, a cable clamping distributor 20 is provided in the housing.

The housing 1 is embedded in a floor consisting of a lower concrete layer 14 and an upper cover layer 15, for example, a prefabricated floor, a floor pavement, etc. The base part is embedded in the floor so that its upper edge and the surface of the cover plate terminate with the upper edge 16 of the floor.

Figure 6:
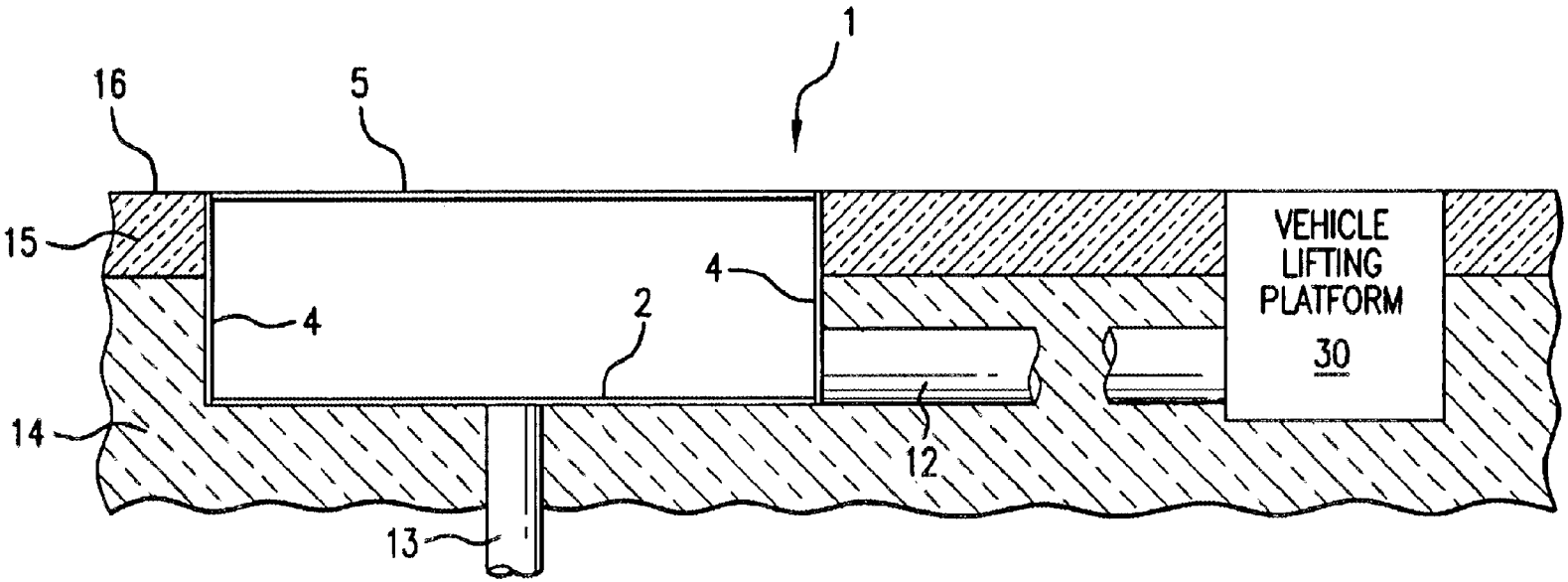
FIG. 6 is a schematic cross-sectional view of an operating device according to the present invention.

FIG. 6 is a schematic cross-sectional view of an operating device for a lifting platform. FIG. 6 illustrates that a housing 1 may be fixed in sunken manner in a floor separate from and adjacent to a vehicle lifting platform 30, which is illustrated schematically.

What is claimed is:

1. An operating device for a vehicle lifting platform, comprising:

a housing, the housing including:

a cover; and a plurality of operating elements disposed in the cover and formed as a foot switch;

wherein the housing is fixed in a sunken manner in a floor separate from and adjacent to the vehicle lifting platform, the cover disposed at a level of the floor; and wherein the operating elements include a first foot switch configured to lift the lifting platform, a second foot switch configured to lower the lifting platform and a safety foot switch, the first foot switch, the second foot switch and the safety foot switch being arranged inside of the cover, the safety foot switch being arranged at a distance to the first foot switch and the second foot switch, the safety foot switch being configured to activate the first foot switch and the second foot switch.

2. The operating device according to claim 1, wherein an upper side of the cover is configured to be aligned with the level of the floor.

3. The operating device according to claim 1, wherein the operating elements include an emergency de-activation foot switch arranged inside of the cover.

4. The operating device according to claim 1, wherein the housing includes a foundation pan, the foundation pan including a bottom plate, a longitudinal wall and a transverse wall.

5. The operating device according to claim 4, further comprising an outlet connection piece disposed on the bottom plate.

6. The operating device according to claim 4, further comprising an empty pipe connection piece disposed in at least one of the longitudinal wall and the transverse wall, the empty pipe connection piece being configured to receive at least one line connected to at least one of a switching device and the lifting platform.

7. The operating device according to claim 1, further comprising at least one display device provided in one of the housing and the cover, the at least one display device being configured to provide a display in accordance with predetermined operating states.

* * * * *